US008322696B2

(12) United States Patent
McClaran

(10) Patent No.: US 8,322,696 B2
(45) Date of Patent: Dec. 4, 2012

(54) MULTI-SEAL VACUUM HOLD DOWN

(76) Inventor: Michael McClaran, Chino Hills, CA (US)

( * ) Notice: Subject to any disclaimer, the term of this patent is extended or adjusted under 35 U.S.C. 154(b) by 529 days.

(21) Appl. No.: 12/715,350

(22) Filed: Mar. 1, 2010

(65) Prior Publication Data

US 2010/0156014 A1 Jun. 24, 2010

Related U.S. Application Data

(63) Continuation-in-part of application No. 11/484,041, filed on Jul. 10, 2006, now Pat. No. 7,669,839.

(51) Int. Cl.
*B25B 11/00* (2006.01)

(52) U.S. Cl. ..... 269/21; 269/289 R

(58) Field of Classification Search ..... 269/21, 269/20, 289 R, 900; 294/64.1; 279/3; 451/388
See application file for complete search history.

(56) References Cited

U.S. PATENT DOCUMENTS

| | | | | |
|---|---|---|---|---|
| 1,505,626 | A | 8/1924 | Debaecker | |
| 2,680,994 | A | 6/1954 | Wood | |
| 2,782,574 | A | 2/1957 | Copold | |
| 4,221,356 | A | 9/1980 | Fortune | |
| 4,428,815 | A | 1/1984 | Powell et al. | |
| 4,723,766 | A | 2/1988 | Beeding | |
| 4,906,011 | A | 3/1990 | Hiyamizu et al. | |
| 5,177,857 | A | 1/1993 | Ito | |
| 5,222,719 | A | 6/1993 | Effner | |
| 5,553,837 | A | 9/1996 | Kahle | |
| 5,987,729 | A | 11/1999 | Moran | |
| 6,089,801 | A | 7/2000 | Hardesty | |
| 6,217,013 | B1 | 4/2001 | Foreman | |
| 6,257,564 | B1 | 7/2001 | Avneri et al. | |
| 6,286,822 | B1 | 9/2001 | Blick | |
| 6,439,559 | B1 * | 8/2002 | Kinnard et al. | 269/21 |
| 6,655,671 | B2 | 12/2003 | Iwaki | |
| 6,764,258 | B1 * | 7/2004 | Akre | 409/219 |
| 6,883,791 | B1 | 4/2005 | Liang et al. | |
| 6,889,967 | B2 | 5/2005 | Brown | |
| 7,669,839 | B2 * | 3/2010 | McClaran | 269/21 |
| 2005/0029724 | A1 * | 2/2005 | Gordon | 269/21 |
| 2008/0006975 | A1 * | 1/2008 | McClaran | 269/21 |
| 2010/0156014 | A1 * | 6/2010 | Mcclaran | 269/21 |

* cited by examiner

*Primary Examiner* — Lee D Wilson
(74) *Attorney, Agent, or Firm* — Kenneth L. Green

(57) ABSTRACT

A three piece vacuum cup is made from rubber to resist damage and facilitates reconfiguring when badly damaged or for specific applications. The vacuum cup includes top, center, and bottom parts. The top is easily and inexpensively replaceable. A flexible lip seal surrounds the top edge of the top to seal against irregular surfaces and damage to the lip seal may be addressed by inserting a cord seal into slots in the top to form a second seal. Part of the top may be cut away to use with small parts and sealed using the cord seal. The center includes a family of passages which may be selectively blocked to permit use of partial tops. A bar pattern on the top has bars aligned in perpendicular directions to better hold material in all cutting directions.

17 Claims, 9 Drawing Sheets

MULTI-SEAL VACUUM HOLD DOWN

The present application is a Continuation in Part of U.S. patent application Ser. No. 11/484,041 filed Jul. 10, 2006, which application is incorporated in its entirety herein by reference.

BACKGROUND OF THE INVENTION

The present invention relates to vacuum hold downs and in particular to vacuum cups for CNC machines.

Various machines exist for performing operations on various types of materials. Vacuum is often used to hold the material in place while the operations are performed. Examples of such machines are Biesse machines made for boring and routing of engineered (for example, particle board) and solid wood, composited, plastics, and soft metals (for example, aluminum). These, and other machines, often utilize vacuum pods or cups which may be positioned for a particular work piece or operation. The cups may interface with the machine in various manners, and are generally approximately square and approximately six inches across, although the size and shape may vary.

Known cups are made from a phenolic material. Phenolic material is generally a plastic-like resin which is both hard and strong. Phenolic material is commonly used as a wood worked surface, for example, as an insert for router tables, because cutters can cut into the phenolic material without damaging the cutter. Vacuum cups generally have narrow edges outlining the perimeter of a top surface of the cups for providing a vacuum seal, and cups made from the phenolic material are easily damaged when a cutter meets the narrow edges or when material is loaded onto the machine. The edges may be cracked, or a portion of the edge may break away. Unfortunately, even a small crack or chip is likely to spoil the cup's ability to maintain vacuum and prevent further use. The Phenolic (or similar hard material) also requires a gasket to form a vacuum seal and material may slip on the hard surface. Such gaskets are often expensive and may easily be damaged.

U.S. patent application Ser. No. 11/484,041 for "VACUUM HOLD DOWN" discloses a rubber vacuum cup with many advantages over known cups made from phenolic material. However, the vacuum cups disclosed in the '041 application are not suitable for all CNC machines, and a need remains for new vacuum cups for additional CNC machines.

BRIEF SUMMARY OF THE INVENTION

The present invention addresses the above and other needs by providing a three piece vacuum cup which is made from rubber to resist damage and facilitates reconfiguring when badly damaged or for specific applications. The vacuum cup includes top, center, and bottom parts. The top is easily and inexpensively replaceable. A flexible lip seal surrounds the top edge of the top to seal against irregular surfaces and damage to the lip seal may be addressed by inserting a cord seal into slots in the top to form a second seal. Part of the top may be cut away to use with small parts and sealed using the cord seal. The center includes a family of passages which may be selectively blocked to permit use of partial tops. A bar pattern on the top has bars aligned in perpendicular directions to better hold material in all cutting directions.

In accordance with one aspect of the invention, there is provided a vacuum cup comprising a substantially solid rubber body having a bottom surface, a top surface, and sides. A vacuum area is formed on the top surface and a vacuum passage passes between the bottom surface and the vacuum area. A raised edge resides around the top surface of the body for forming a seal with a work piece. Mounting features reside on the bottom surface for mounting the vacuum cup on a machine.

In accordance with another aspect of the invention, there is provided a three piece vacuum cup having a top rubber body, and center portion, and a bottom rubber body. The top rubber body includes a sealing lip around the top edge forming a first seal and recessed channels in a top surface of the top rubber body which receive a sealing cord to form a second redundant seal. If the sealing lip is damages, or if a portion of the top rubber body is cut away, the vacuum cup is still functional using the second seal.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
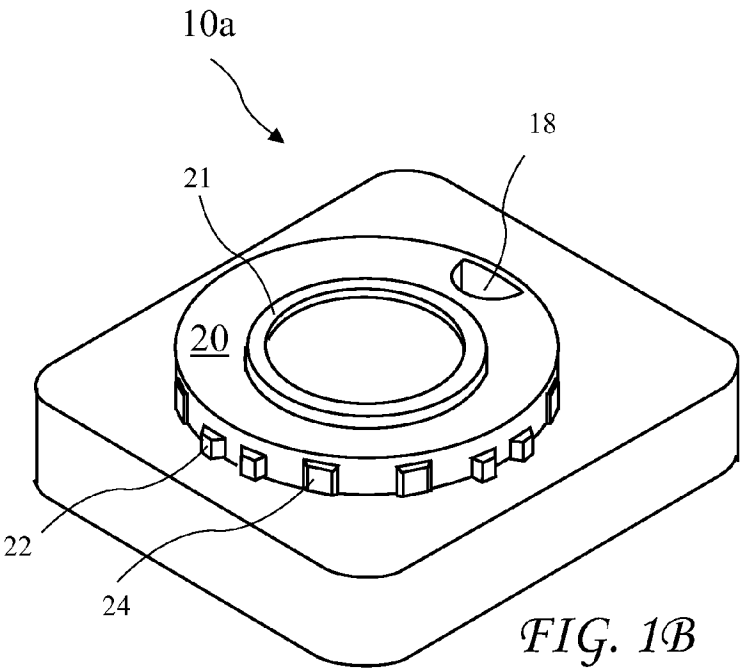
FIG. 1B is a bottom perspective view of the first embodiment of the vacuum cup according to the present invention.
Figure 1A:
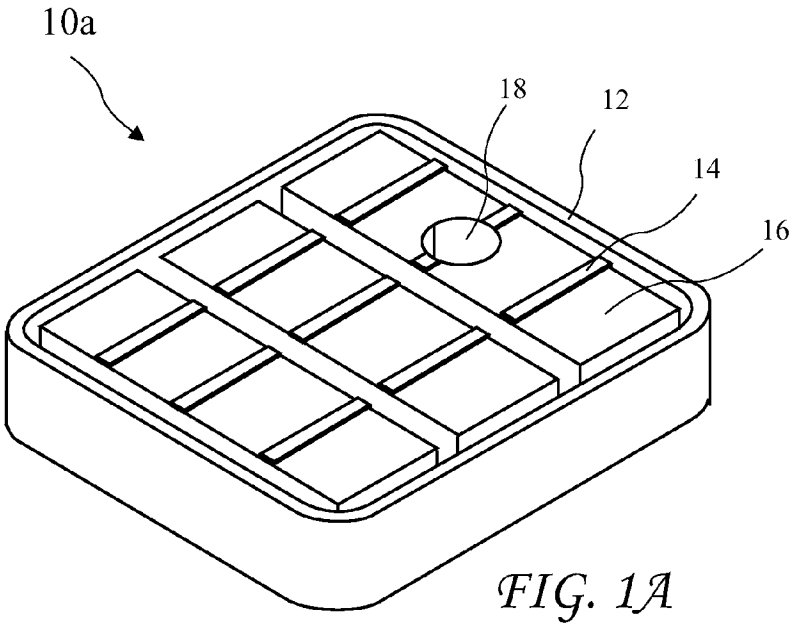
FIG. 1A is a top perspective view of a first embodiment of a vacuum cup according to the present invention.

A top perspective view of a first embodiment of a vacuum cup 10*a* according to the present invention is shown in FIG. 1A, and a bottom perspective view of the first embodiment of the vacuum cup 10*a* is shown in FIG. 1B. The top of the vacuum cup 10*a* includes a raised edge 12 for sealing with a work piece supported and held by the vacuum cup 10*a*, and work piece supports 14 for supporting the work piece. The work piece supports 14 preferably comprise a group of parallel bars and reside on support bases 16. A vacuum passage 18 passes through the vacuum cup 10*a* and connects to a vacuum source. The interior of the raised edge 12 defines a vacuum area for creating a hold down force for holding the work piece.

The bottom of the vacuum cup 10*a* includes a machine interface 20 for cooperating with known CNC machines, for example a Biesse Rover 22 CNC Machining Center or a Biesse Rover 24 CNC Machining Center. The machine interface 20 is a cylindrical protrusion and includes indexing features (or fingers) 22 for cooperation with indexing grooves in CNC machines, and centering pads 24 for cooperation with a corresponding opening in the CNC machines. The vacuum passage 18 is shown extending through the bottom of the vacuum cup 10*a*, and is partially blocked to provide a stop of a known check valve commonly used with vacuum cups.

Known vacuum cups are manufactured from a phenolic material. Phenolic material is generally a plastic-like resin which is both hard and strong. Unfortunately, such known cups break easily and must be replaced frequently. If a replacement is not available when needed, an expensive machine may be sit idle until a new part is obtained. The vacuum cup 10*a* according to the present invention is molded from substantially solid rubber and is much less susceptible to breaking. The vacuum cup according to the present invention is approximately one inch thick and preferably has a Shore hardness of approximately 80 Shore A. An example of a suitable material is compound number EXP7654-80B provided by R&S Processing in Paramount, Calif. Compound Number EXP7654-80B is a natural rubber and is non-blooming. Blooming refers to a tendency of some compounds to give off a powder like material. Such powder reduced friction and would reduce the holding power of the vacuum cups. The compound is crosshatched during molding to equalize shrinkage across the part. Such crosshatching is important to maintain close dimensional tolerances.

Because the material used by the present invention is not stiff like the phenolic material used in known vacuum cups, the vacuum cups 10*a* may flex when vacuum is applied. Such flexing often affects the seal between the material and the vacuum cup. As a result, a vacuum cup according to the present invention often requires additional support structure to prevent flexing. In the instance of the cup 10*a*, the additional support structure is a support ring 21 added to the bottom of the cup. Such support ring 21 rests against a solid surface and thereby provides a support structure.

Figure 2:
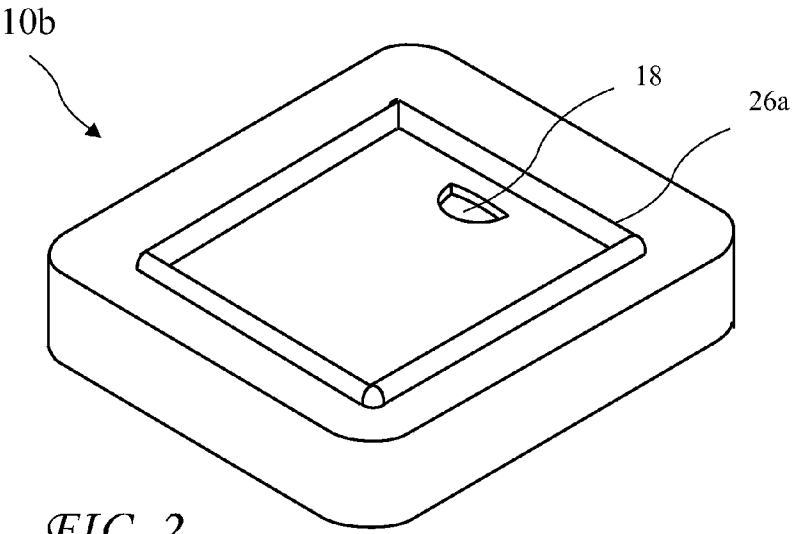
FIG. 2 is a bottom perspective view of a second embodiment of the vacuum cup according to the present invention.
Figure 3:
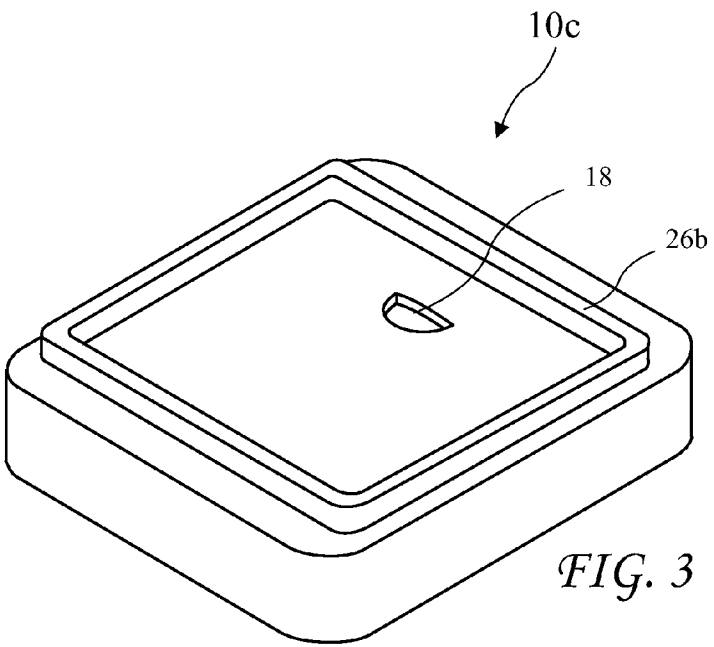
FIG. 3 is a bottom perspective view of a third embodiment of the vacuum cup according to the present invention.

A bottom perspective view of a second embodiment of the vacuum cup 10*b* according to the present invention is shown in FIG. 2, and a bottom perspective view of a third embodiment of the vacuum cup 10*c* according to the present invention is shown in FIG. 3. The vacuum cups 10*b* and 10*c* include alignment features 26*a* and 26*b* respectively. The alignment features 26*a* and 26*b* are preferably rounded or a bullnose shape. The alignment features 26*a* and 26*b* are suitable for use with known CNC machines, and are configured to cooperate with grooves in a flat table machine to position the vacuum cup on the flat table machine.

Figure 4B:
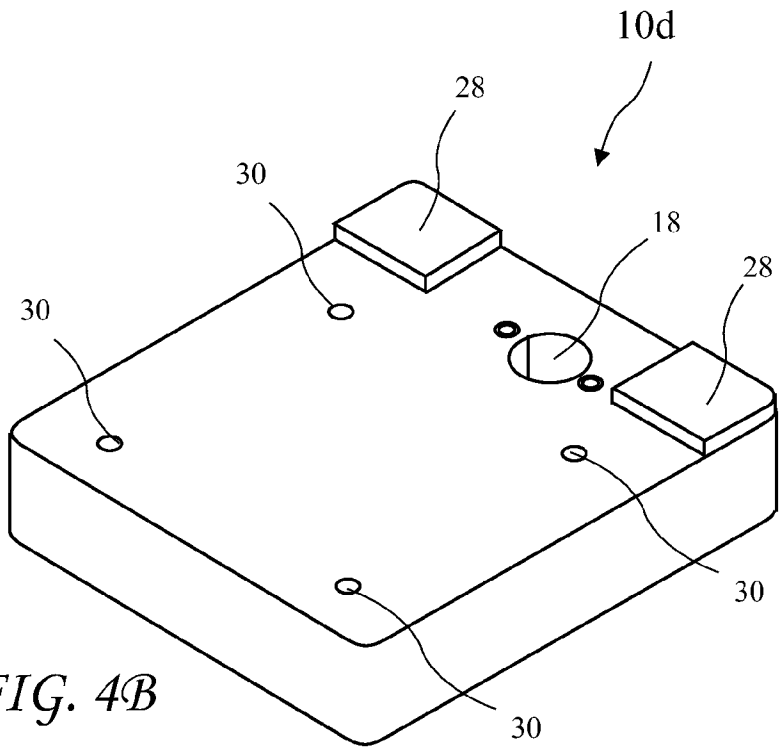
FIG. 4B is a bottom perspective view of the fourth embodiment of the vacuum cup according to the present invention.
Figure 4A:
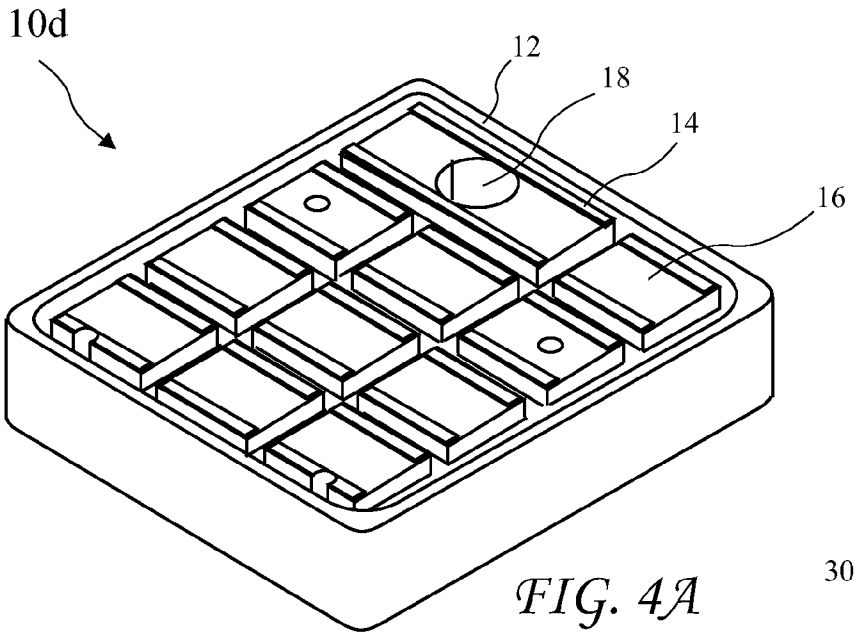
FIG. 4A is a top perspective view of a fourth embodiment of the vacuum cup according to the present invention.

A top perspective view of a fourth embodiment of the vacuum cup 10*d* according to the present invention is shown in FIG. 4A, and a bottom perspective view of the fourth embodiment of the vacuum cup 10*d* is shown in FIG. 4B. The vacuum cup 10*d* is similar to the vacuum cups 10*a*, 10*b*, and 10*c*, but includes side pads 28 along one edge of the vacuum cup bottom to cooperate with support rails of a machine. Such cup is used on machines such as a Biesse Rover 20 machine. The vacuum cup 10*d* further includes four fastener passages 30 for securing the cup to the machine.

Figure 5C:
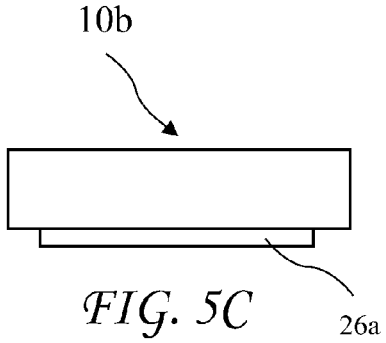
FIG. 5C is an end view of the second embodiment of the vacuum cup.
Figure 5A:
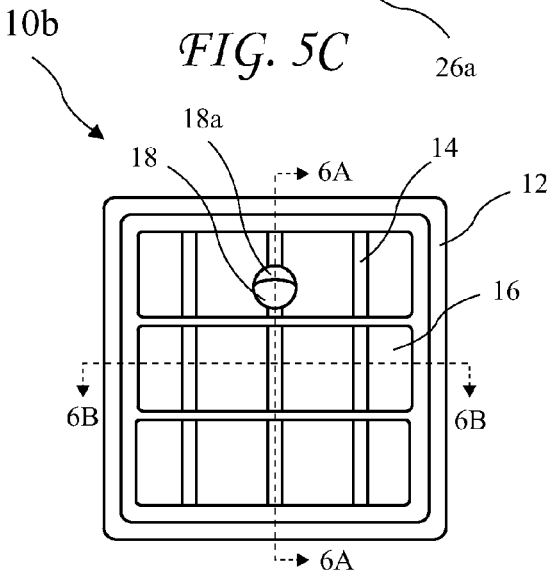
FIG. 5A is a top view of the second embodiment of the vacuum cup.
Figure 5B:
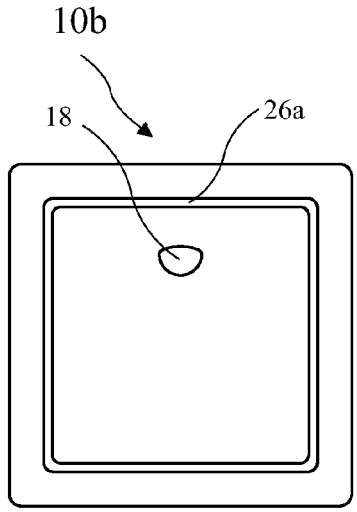
FIG. 5B is a bottom view of the second embodiment of the vacuum cup.
Figure 6A:
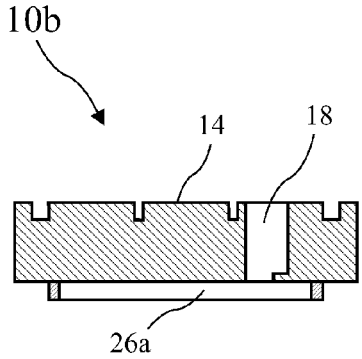
FIG. 6A is a cross-sectional view of the second embodiment of the vacuum cup taken along line 6A-6A of FIG. 5A.
Figure 6B:
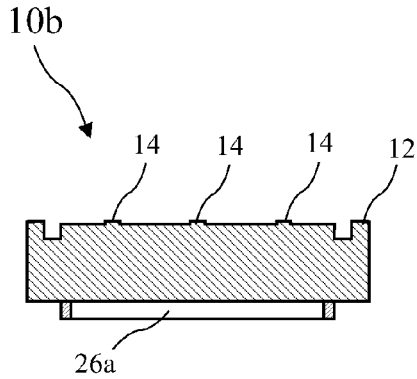
FIG. 6B is a cross-sectional view of the second embodiment of the vacuum cup taken along line 6B-6B of FIG. 5A.

A top view of the second embodiment of the vacuum cup 10*b* is shown in FIG. 5A, a bottom view of the second embodiment of the vacuum cup 10*b* is shown in FIG. 5B, and an end view of the second embodiment of the vacuum cup 10*b* is shown in FIG. 5C. A cross-sectional view of the second embodiment of the vacuum cup 10*b* taken along line 6A-6A of FIG. 5A is shown in FIG. 6A, and a cross-sectional view of the second embodiment of the vacuum cup 10*b* taken along line 6B-6B of FIG. 5A is shown in FIG. 6B. The raised edge 12 rises approximately 0.2 mm above the work piece supports 14.

Figure 7B:
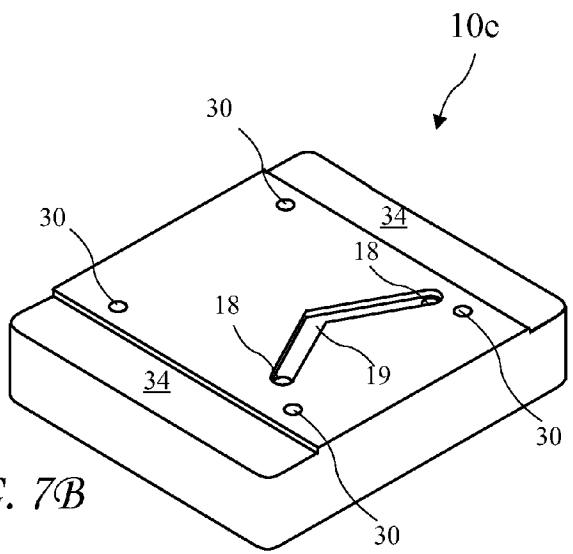
FIG. 7B is a bottom perspective view of the fifth embodiment of the vacuum cup according to the present invention.
Figure 7A:
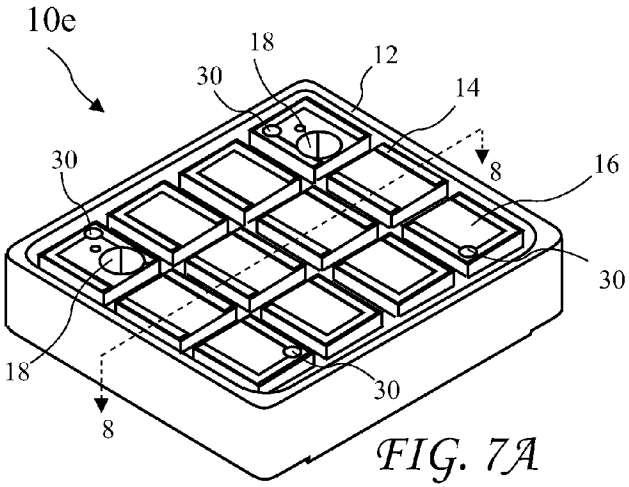
FIG. 7A is a top perspective view of a fifth embodiment of the vacuum cup according to the present invention.
Figure 8:
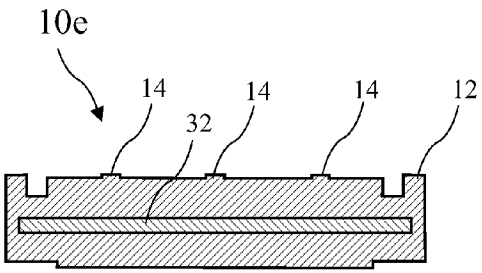
FIG. 8 is a cross-sectional view of the fifth embodiment of the vacuum cup taken along line 8-8 of FIG. 7A.

A top perspective view of a fifth embodiment of the vacuum cup 10*e* according to the present invention is shown in FIG. 7A, a bottom perspective view of the fifth embodiment of the vacuum cup 10*e* is shown in FIG. 7B, and a cross-sectional view of the fifth embodiment of the vacuum cup 10*e* taken along like 8-8 of FIG. 7A is shown in FIG. 8. The vacuum cup 10*e* is similar to the vacuum cups 10*a*, 10*b*, 10*c* and 10*d*, but includes recesses 34, a "V" shaped vacuum slot 19, and a support structure comprises an insert 32. The insert 32 is a plate embedding in the vacuum cup 10*e* and is preferably a nylon insert, and more preferably a Delrin® insert, and is preferably approximately ⅜ inches thick. The insert 32 is preferably etched to provide better adhesion of the rubber vacuum cup body to the insert 32, and more preferably the insert 32 is etched using plasma surface modification.

An example of a suitable plasma surface modification of the insert 32 is performed using a 2051 Series Plasma System made by TriStar Plastics, Corp. In Brea, Calif. Plasma is a state-of-matter which is different from the other three states (solid, liquid, or gas). In a steady state condition, plasma is a quasineutral cloud which contains free electrons and ions. In a disassociated state, plasma consists of electrons, ions, unexcited molecules and free radicals. Plasma may be generated by turning non-reactive molecules into reactive molecules by introducing energy, such as an electrical charge. Extremely reactive plasmas may be created by using an electrical charge to break up safe inert gases, for example, freons. When freons are electrified, they produce large quantities of chlorine and fluorine, both highly reactive compounds. These are the compounds which contain the ions and free radicals which actually do the "etching". In addition, the directionality and degree of reactivity can be controlled by the amount of applied power. The ability to control the directionality and degree of reactivity of the plasma etching process enables the engineer to "control the etch", which makes dry etching (e.g., plasma etching) more controllable than wet etching.

Methods for selecting parameters for plasma etching are well known to those skilled in the art. For plasma etching of the insert 32, the plasma pressure is preferably maintained between 0.05 Torr to 2.0 Torr, and more preferably between 0.250 Torr and 0.350 Torr. The RF power setting is preferably between 20 Watts to 2500 Watts, and more preferably between 800 Watts and 1,000 Watts. The RF generator frequency is variable, but is preferably approximately 13.56 MHZ. The gas species used in this invention may be any pure gas or gas mixture which would provide an oxidized surface. Commonly preferred gasses include oxygen (O2), nitrous (N2O), argon (Ar), helium (He), carbon dioxide (C2O), or any mixture there of. The duration of the treatment is variable based on polymer load (i.e., the quantity of polymer parts in the chamber to be treated) and surface area of the polymer load. Based on standard polymer load, and size of substrate the time is preferably between 2 to 45 min, and more preferably, the time is between 15 minutes to 25 minutes. Those skilled in the art would generally modify the time for their specific machine setup.

After a substrate has been treated using the above method, the surface is molecularly etched and chemically modified. This type of surface activation can be measured via goniometry (contact angle measurement) or dynes inks. The governing equation is Young's equation where:

$$Ysv - Ysl = Ylv * Cos\ \Theta$$

where Ysv is the surface free energy of the solid in contact with vapor, Ysl is the surface free energy of the solid covered with liquid, Ylv is the surface free energy of the liquid-vapor, and interface Θ is the contact angle.

Contact angles are measured in degrees. "Low" is below about 20° and "high" as 90° or above. Water on poly-tetrafluoroethylene PTFE is about 112°, very high. Low angles mean wettable. Surface energy (the terminology generally used for solids) and surface tension (the terminology generally used for fluids) are measured in dynes/cm. Water has a surface tension of 72.8 dynes/cm at room temperature. The surface energy of most solids falls between 15 and 100 dynes/cm. If the surface tension of the fluid is below the surface energy of the solid, the fluid will spread rather than staying in a little droplet. Polymer surfaces are often treated to improve this wettability by raising their surface energy.

Figure 9:
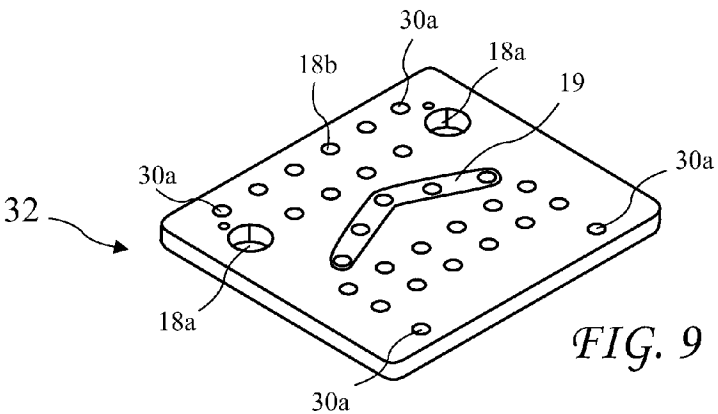
FIG. 9 is an insert molded into a vacuum cup to reduce or prevent bending which may cause vacuum leaks.

A detailed top perspective view of the insert 32 is shown in FIG. 9. The insert 32 is preferably made or pre-drilled with passages 30*a* aligned with the fastener passages 30 and passages 18*a* aligned with the vacuum passages 18 in the vacuum cup to simplify molding the vacuum cup 10*e*. The fastener passages 30*a* and the vacuum passages 18*a* are preferably over-sized to allow inside edges of the fastener passages 30*a* and the vacuum passages 18*a* to be embedded within the vacuum cup. The outside dimensions of the insert 32 are undersized compared to the vacuum cup to allow embedding of the insert 32 within the vacuum cup. Additional holes 18*b* (one of a multiplicity of holes 18*b* is labeled in FIG. 9) are spaced apart on the insert 32 to allow molding material to flow through the insert 32 to prevent the vacuum cup from ballooning when vacuum is applied thereto. A second "V" shaped vacuum slot 19*a* may be provided in the insert 32, for example, to distribute vacuum and several of the holes 18*b* may be aligned with the slot 19*a* to help distribute vacuum.

Figure 10:
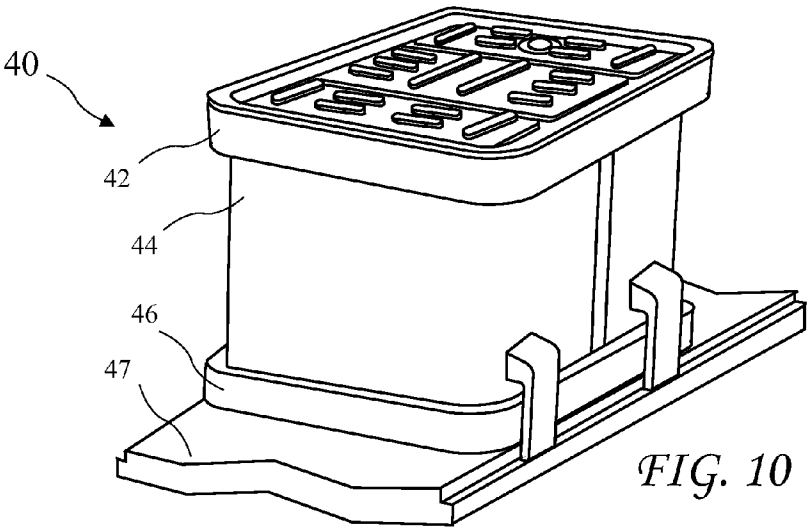
FIG. 10 is a top perspective view of a three piece vacuum cup assembly according to the present invention.
Figure 11B:
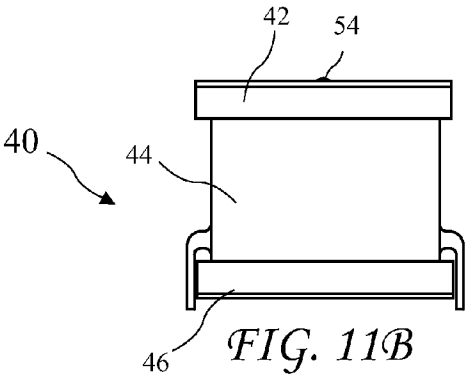
FIG. 11B is an end view of the three piece vacuum cup assembly according to the present invention.
Figure 11C:
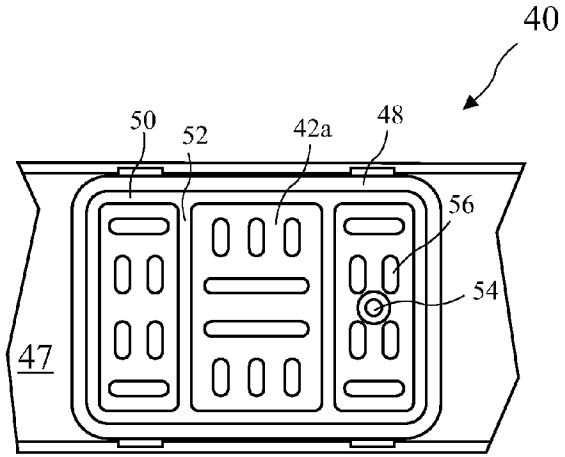
FIG. 11C is a top view of the three piece vacuum cup assembly according to the present invention.
Figure 11A:
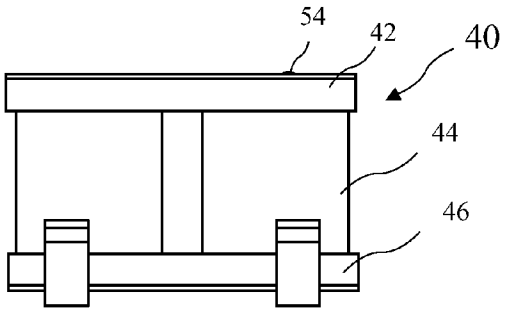
FIG. 11A is a side view of the three piece vacuum cup assembly according to the present invention.

A top perspective view of a three piece vacuum cup assembly 40 according to the present invention is shown in FIG. 10, a side view of the three piece vacuum cup assembly 40 is shown in FIG. 11A, an end view of the three piece vacuum cup assembly 40 is shown in FIG. 11B, and a top view of the three piece vacuum cup assembly 40 is shown in FIG. 11C. The three piece vacuum cup assembly 40 is assembled from a top rubber body 42, and center portion 44 and a bottom rubber body 46. The top rubber body 42 has a top surface 42*a* having a sealing lip 48 forming a closed perimeter around the top edge of the top rubber body 42 and providing a first seal, and a perimeter recessed channel 50 on the top surface 42*a* forming a closed path just inside the sealing lip 48 for receiving a sealing cord 51 (see FIG. 15) to provide a redundant second seal. If the sealing lip 48 is cut or otherwise damaged to prevent forming the first seal, the sealing cord 51 may be inserted into the channels 50 to form the second seal. Additionally, at least one interior recessed channel 52 is formed on the top surface 42*a* and if part of the top rubber body 42 is cut away the sealing cord 51 may be inserted into a close path formed from part of the perimeter recessed channel 50 and at least one of the interior recessed channels 52 to form the second seal. A check valve 54 resides in the top rubber body controlling the communication of a vacuum signal to the top surface 42*a* and the top rubber body 42 may further include any of the features described for the single piece vacuum cups above.

The center portion 44 forms a spacer to separate the top rubber body 42 from the bottom rubber body 46. The center portion 44 further provides structure (for example, vertical channels 60, see FIGS. 18 and 19) for control the communication of vacuum between the bottom and top rubber bodies 46 and 42. A more detailed description of the center portion 44 follows. The bottom rubber body 46 mates to the center portion 44 and cooperates with a machine surface 47 for support and for communication to a source of vacuum.

Figure 13B:
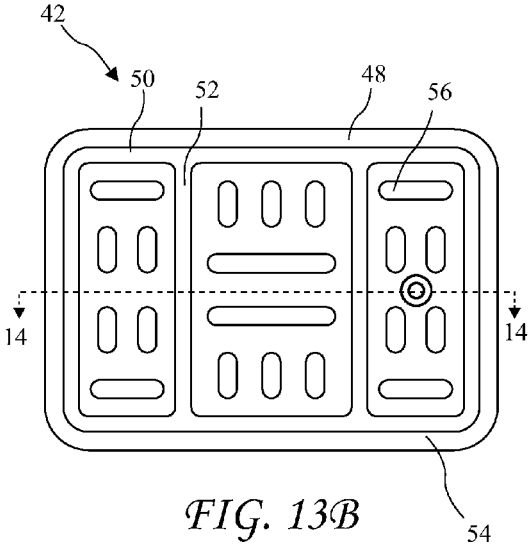
FIG. 13B is a top view of the top rubber body according to the present invention.
Figure 12:
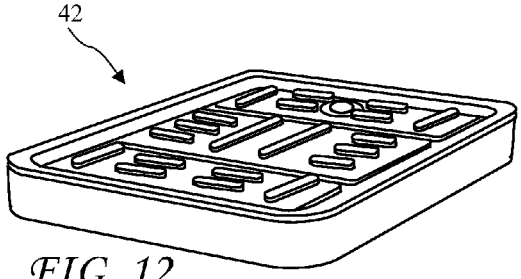
FIG. 12 is a top perspective view of a top rubber body assembly according to the present invention.
Figure 13A:
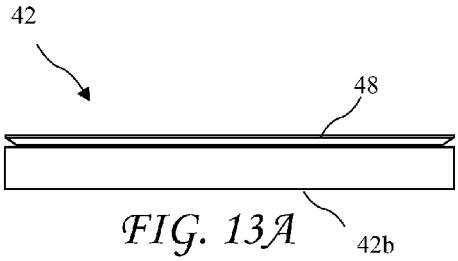
FIG. 13A is a side view of the top rubber body according to the present invention.
Figure 13C:
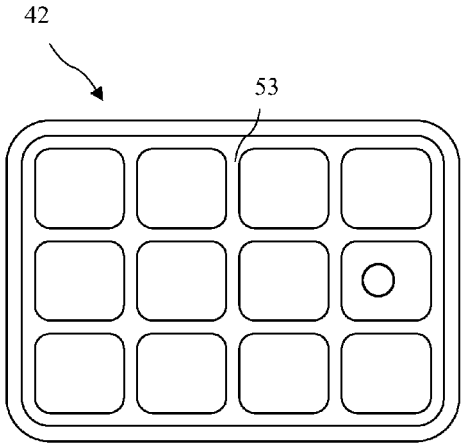
FIG. 13C is a bottom view of the top rubber body according to the present invention.

A top perspective view of the top rubber body 42 according to the present invention is shown in FIG. 12, a side view of the top rubber body 42 is shown in FIG. 13A, a top view of the top rubber body 42 is shown in FIG. 13B, and a bottom view of the top rubber body 42 is shown in FIG. 13C. If the sealing lip 48 is damaged, or if a large portion of the top rubber body 42 is accidentally cut away, a length of the sealing cord 51 (see FIG. 15A) may be inserted into a combination of the perimeter recessed channel 50 and/or the interior recessed channel 52 to form a new second seal to replace a seal formed by the sealing lip 48. The sealing cord 51 may be round or oval or have a "D" cross-section and a length of the sealing cord 51 is inserted into the perimeter recessed channels 50 and/or the interior recessed channel 52 with ends of the sealing cord 51 butted together to form a closed path. A groove pattern 53 is formed in the bottom surface of the top rubber body 42. The groove pattern 53 matches the top edge of the center portion 44 and cooperated with the top edge of the center portion 44 to fit the top rubber body 42 to the center portion 44. A fixed vacuum passage 55 passes through the top rubber body 42 to communicate a vacuum signal to the top surface of the top rubber body 42.

Figure 14:
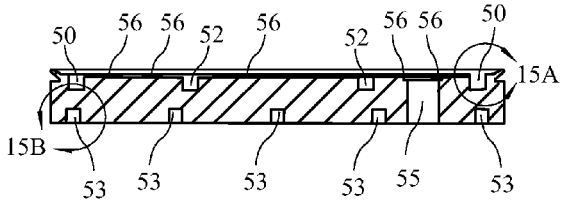
FIG. 14 is a cross-sectional view of the top rubber body according to the present invention taken along line 14-14 of FIG. 13B.
Figure 15A:
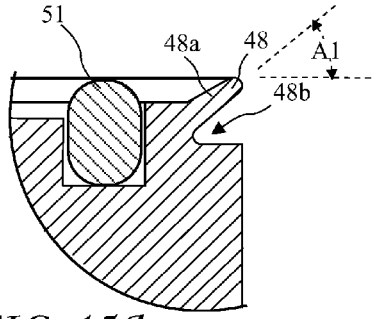
FIG. 15A is a cross-sectional view of detail 15A of the FIG. 14 of a top sealing lip of the top rubber body according to the present invention.
Figure 15B:
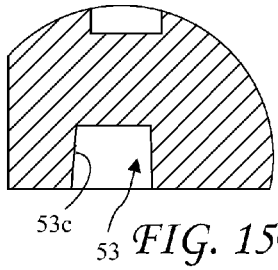
FIG. 15B is a cross-sectional view of detail 15B of the FIG. 14 of a groove pattern on a bottom surface of the top rubber body according to the present invention.

A cross-sectional view of the half size top rubber body 42' taken along line 14-14 of FIG. 13B is shown in FIG. 14, a cross-sectional view of detail 15A of the FIG. 14 of the top sealing lip 48 of the half size top rubber body 42' is shown in FIG. 15A, and a cross-sectional view of detail 15B of the FIG. 14 showing the groove pattern 53 on the bottom surface of the top rubber body 42 is shown in FIG. 15B. The sealing lip 48 reaches upward and outward from the rubber body 42 at an angle A1, and preferably at an angle A1 of approximately 40 degrees. A top lip surface 48*a* forms a bowl around the first top surface 42*a* of to top rubber body 42. A "V" shaped cut 48*b* in the sides of the top rubber body 42 completes a closed path around the top rubber body 42 and allows the sealing lip 48 to conform to irregular shaped work pieces. The groove pattern 53 in the bottom surface 42*b* of the top rubber body 42 matches a pattern of vertical walls 62 (see FIGS. 18 and 19) of the center portion 44 allowing the vertical walls 62 to reach into the first bottom surface of the top rubber body 42. A tapered wall 53*a* outlines the groove pattern 53 and tapers in narrowing the groove pattern to pinch the vertical walls 62 to provide a tight fit between the groove pattern 53 of the top rubber body 42 and the vertical walls 62 of the center portion 44. A cross-section of the sealing cord 51 is shown with the sealing cord 51 inserted into the perimeter recessed channels 50. The sealing cord 51 may have a round, elliptical, oval, or "D" shaped cross-section and the closed path of the seal is formed by butting ends of a length of the sealing cord 51 together. The sealing cord 51 may thus be used with any length closed path including a combination of the perimeter recessed channels 50 and/or one or more of the interior recessed channels 52.

Figure 16B:
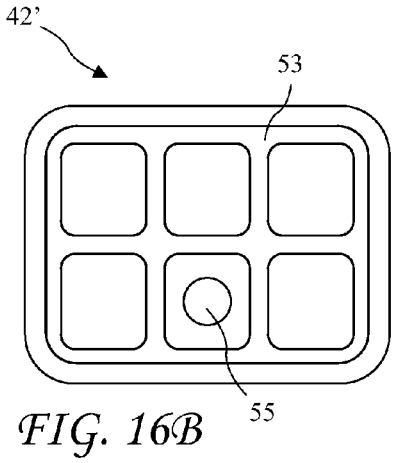
FIG. 16B is a bottom view of the half size top rubber body according to the present invention.
Figure 16A:
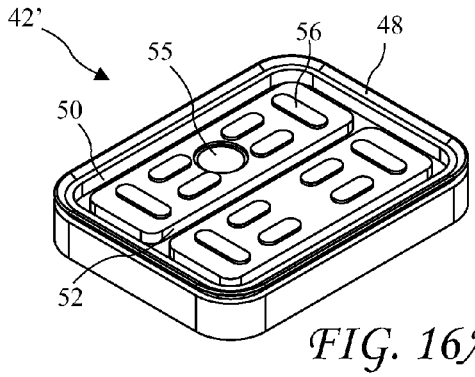
FIG. 16A is a top perspective view of a half size top rubber body assembly according to the present invention.

A top perspective view of a half size top rubber body 42' according to the present invention is shown in FIG. 16A and a bottom view of the half size top rubber body 42' is shown in FIG. 16B. A novel advantage of the present invention is the ability to form a second seal if the sealing lip 48 is damaged. Additionally, a smaller top rubber body, such as the half size top rubber body 42' may be used for small parts. The half size top rubber body 42' includes the same features as the top rubber body 42, but has half the length of the top rubber body 42.

Figure 17A:
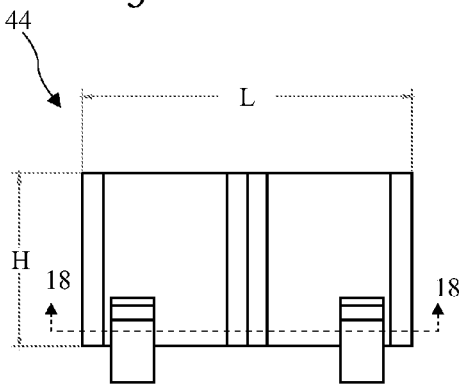
FIG. 17A is a side view of a center portion of the three piece vacuum cup assembly according to the present invention.
Figure 17B:
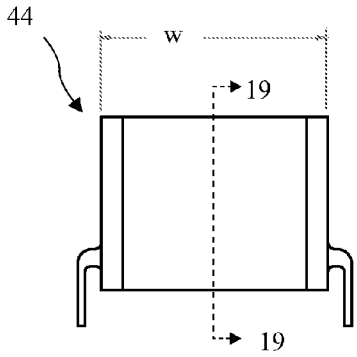
FIG. 17B is an end view of the center portion of the three piece vacuum cup assembly according to the present invention.
Figure 18:
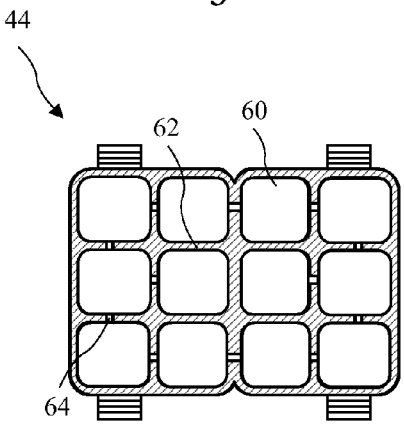
FIG. 18 is a cross-sectional view of the center portion of the three piece vacuum cup assembly according to the present invention taken along line 18-18 of FIG. 17A.
Figure 19:
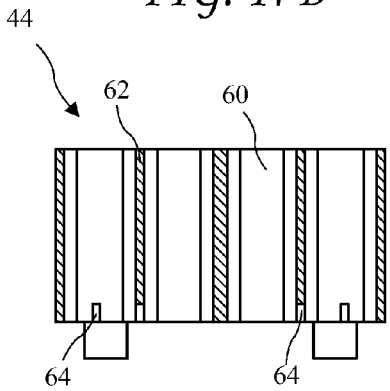
FIG. 19 is a cross-sectional view of the center portion of the three piece vacuum cup assembly according to the present invention taken along line 19-19 of FIG. 17B.

A side view of a center portion 44 of the three piece vacuum cup assembly 40 is shown in FIG. 17A, an end view of the center portion 44 is shown in FIG. 17B, a cross-sectional view of the center portion 44 taken along line 18-18 of FIG. 17A is shown in FIG. 18, and a cross-sectional view of the center portion 44 taken along line 19-19 of FIG. 17B is shown in FIG. 19. The center portion 44 includes interior walls 62 forming a rectangular array of vertical passages 60 reaching from the bottom to the top of the center portion 44. The vertical passages 60 are connected by ports 64 at a base of the center portion 44, the vertical passages 60 connecting the vertical passages 60 placing all the vertical passages 60 in communication with the vacuum source through the ports 64 to provide vacuum to all of the vertical passages 60 when the vacuum is applied to one of the vertical passages 60.

Figure 20:
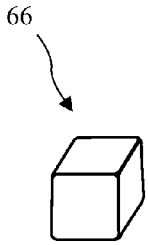
FIG. 20 shows a plug according to the present invention for blocking individual vertical passages in the center portion.

A plug 66 is shown in FIG. 20. The plugs 66 are used for blocking individual vertical passages 60 in the center portion 44 when less than the entire top rubber body 42 is used to prevent a vacuum leak, and the plug 66 thus has a horizontal cross-section approximately matching the horizontal cross-section of the vertical passage 60 to allow using the plug 66 to block the vertical passage 60. For example, when the half size top rubber body 42' is used, half of the vertical passages are blocked. Further, the vacuum cup 40 may be cut into during use damaging the top rubber body 42 and sometimes the center portion 44. The plugs 66 are used to seal any of the vertical passages 60 which otherwise would create a vacuum leak. The plug 66 preferably had rounded or radiused edges and is preferably tapered having a smaller top insertable into a vertical passage 60 and a larger bottom to resist complete insertion into the vertical passage 60.

Figure 21B:
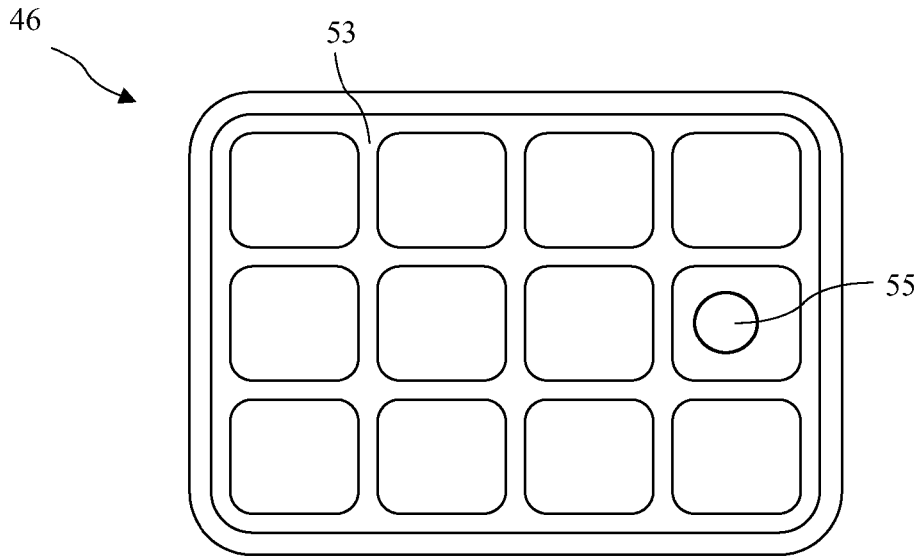
FIG. 21B shows a top view of the bottom rubber body according to the present invention.
Figure 21A:
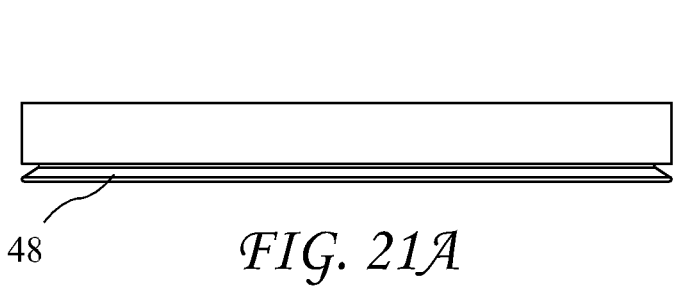
FIG. 21A shows a side view of the bottom rubber body according to the present invention.
Figure 21C:
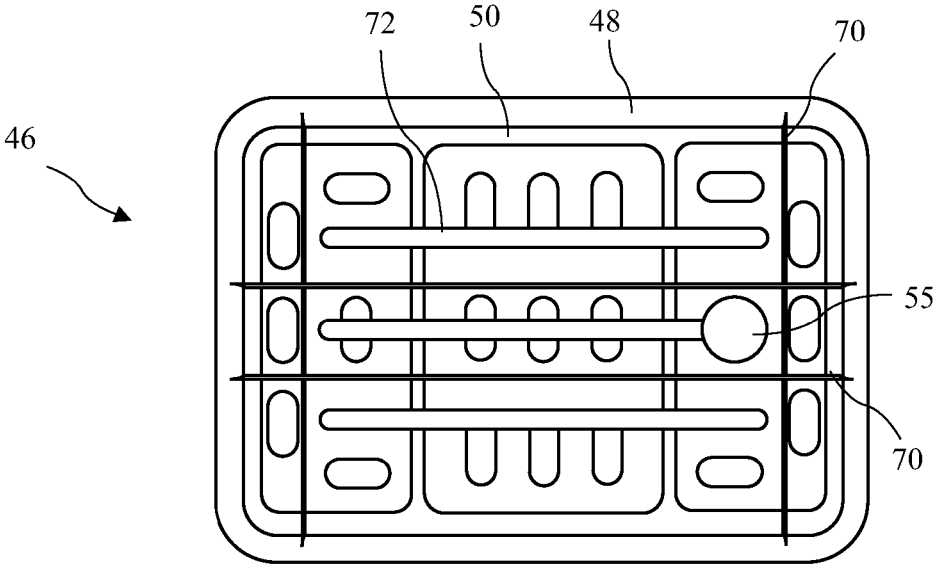
FIG. 21C shows a bottom view of the bottom rubber body according to the present invention.

A side view of a bottom surface of a bottom rubber body 46 according to the present invention is shown in FIG. 21A, a top view of the bottom rubber body 46 is shown in FIG. 21B, and a bottom view of the bottom rubber body 46 is shown in FIG. 21C. The top surface of the bottom rubber body 46 includes the groove pattern 53 for attaching and sealing to the center portion 44. The bottom surface of the bottom rubber body 46 is similar to the top surface of the top rubber body with two additional features. The bottom surface of the bottom rubber body 46 includes three long grooves 72 for receiving metal bars, the metal bars for attracting the vacuum cup 40 to magnets in a machine. The metal bars may be held by adhesive or molded into the bottom rubber body or any suitable means. The bottom surface of the bottom rubber body 46 further includes two pairs of partitioning walls 70 blocking the communication of vacuum between a right side, and center, and a left side of a vacuum area on the bottom surface of the bottom rubber body 46 for controllably allowing a first vacuum source to hold the vacuum cup 40 to the machine and a second vacuum source to hold the work piece to the vacuum cup 40.

While features of the top rubber body 42 were only shown with the three piece vacuum cup assembly 40, such features are also compatible with single piece vacuum cups shown in FIGS. 1-9, and vacuum cups with any combination of the features disclosed herein are intended to come within the scope of the present invention. For example, the sealing lip 48, the channels 50 and 52, and the sealing cord 51 may be applied to any of the vacuum cups shown in FIGS. 1-9.

While the invention herein disclosed has been described by means of specific embodiments and applications thereof, numerous modifications and variations could be made thereto by those skilled in the art without departing from the scope of the invention set forth in the claims.

I claim:

1. A vacuum cup comprising:

a flexible rubber body having a bottom surface, a top surface fixedly aligned above the bottom surface, and sides, and defining a volume having a substantially rectangular shape;

a vacuum area formed on the top surface of the rubber body;

a fixed vacuum passage passing between the bottom surface and the vacuum area and placing the vacuum area in communication with a vacuum source; and two redundant sealing features comprising:

a sealing lip forming a closed perimeter around a top edge of the top surface for coming in direct contact with a work piece to form a first seal with the work piece; and a perimeter recessed channel molded into the rubber body and defining a first closed path on the top surface of the rubber body enclosing the vacuum area and sealing cord residing in the perimeter recessed channel for coming in direct contact with the work piece to form a second seal with the work piece inside the first seal.

2. The vacuum cup of claim 1, wherein:

a check valve resides in the rubber body and a depressable portion of the check valve reached above the work piece supports; and the check valve is biased to a close position to block a flow through the vacuum passage for preventing material from passing the check valve when the work piece is not resting on the work piece supports; and the check valve is pushed to an open position to allow creation of a vacuum in the vacuum area when the work piece is resting on the work piece supports.

3. The vacuum cup of claim 1, wherein the sealing lip comprises a top lip surface extending upward and outward from the rubber body forming a bowl shape.

4. The vacuum cup of claim 3, wherein the rubber body includes a "V" shaped cut under the sealing lip for allowing the sealing lip to conform to irregular surfaces of the work piece.

5. The vacuum cup of claim 1, wherein the vacuum area includes work piece supports molded into the top surface of the rubber body and residing inside the first closed path defined by the perimeter recessed channel.

6. The vacuum cup of claim 5, wherein the work piece supports are slightly below the sealing lip when the work piece is not resting on the sealing lip.

7. The vacuum cup of claim 6, further including at least one interior recessed channel connecting spaced apart points on the perimeter recessed channel and passing between at least two of the work piece supports, the sealing cord forming a second closed path including the at least one interior recessed channel and part of the perimeter recessed channel and defining a smaller area inside a larger area defined by the first close path, the sealing cord coming in direct contact with the work piece to form a third seal with the work piece for holding small parts.

8. The vacuum cup of claim 1, wherein:

the rubber body is part of a multi-piece vacuum cup and resides above a center portion;

the center portion includes vertical passages separated by vertical walls; and the vertical passages place the fixed vacuum passage in communication with the vacuum source.

9. The vacuum cup of claim 8, wherein:

the bottom surface of the rubber body includes a groove pattern matching the vertical walls of the center portion.

10. The vacuum cup of claim 9, wherein a tapered wall outlines the groove pattern, the tapered wall tapering in to pinch the vertical walls to provide a tight fit between the groove pattern and the vertical walls of the center portion.

11. The vacuum cup of claim 10, wherein:

the vertical walls include notches at a base of the center portion and the vertical passages are in communication with the vacuum source through the notches to provide vacuum to all of the vertical passages when the vacuum is applied to one of the vertical passages; and the vacuum cup further including plugs insertable into the vertical passages to block the vacuum from communicating to the rubber body through the blocked vertical passage for allowing use of a partial rubber body.

12. The vacuum cup of claim 10, wherein the rubber body is a top rubber body and the vacuum cup further includes a bottom rubber body, a second top surface of the bottom rubber body including the same groove pattern as the top rubber body for attaching to the center portion.

13. The vacuum cup of claim 12, wherein a second bottom surface of the bottom rubber body includes the sealing lip and the recessed channels and additionally includes partitioning walls blocking the communication of vacuum between a right side, and center, and a left side of a second vacuum area on the bottom surface of the bottom rubber body for controllably allowing a first vacuum source to hold the vacuum cup to the machine and a second vacuum source to hold the work piece to the vacuum cup.

14. The vacuum cup of claim 13, wherein the second bottom surface of the bottom rubber body includes long grooves for receiving metal bars, the metal bars attracting the vacuum cup to magnets in a machine.

15. The vacuum cup of claim 1, wherein the rubber body includes a substantially solid structure between the work piece supports and the body bottom surface to resist flexing due to vacuum and to work piece weight.

16. A vacuum cup comprising:

a flexible rubber body having a bottom surface, a top surface fixedly aligned above the bottom surface, and sides, and defining a volume having a substantially rectangular shape;

a vacuum area formed on the top surface of the rubber body;

a fixed vacuum passage passing between the bottom surface and the vacuum area and placing the vacuum area in communication with a vacuum source;

two redundant sealing features comprising:

a sealing lip comprises a top lip surface extending upward and outward from the rubber body forming a bowl shape and the rubber body includes a "V" shaped cut under the sealing lip for allowing the sealing lip to conform to irregular surfaces of the work piece, the sealing lip forming a closed perimeter around a top edge of the top surface for coming in direct contact with a work piece to form a first seal with the work piece; and a perimeter recessed channel molded into the rubber body and defining a first closed path on the top surface of the rubber body enclosing the vacuum area and sealing cord residing in the perimeter recessed channel for coming in direct contact with the work piece to form a second seal with the work piece inside the first seal; and work piece supports molded into the top surface of the rubber body and residing inside the first closed path defined by the perimeter recessed channel, the work piece supports slightly below the sealing lip when the work piece is not resting on the sealing lip.

17. A vacuum cup comprising:

a top rubber body having a first bottom surface, a first top surface fixedly aligned above the first bottom surface, and sides, and defining a volume having a substantially rectangular shape;

a top vacuum area formed on the first top surface of the top rubber body;

a fixed vacuum passage passing between the first bottom surface and the top vacuum area and placing the top vacuum area in communication with a vacuum source; and two redundant sealing features comprising:

a top sealing lip comprises a top lip surface extending upward and outward from the rubber body forming a bowl shape and the top rubber body includes a "V" shaped cut under the top sealing lip for allowing the top sealing lip to conform to irregular surfaces of the work piece, the top sealing lip forming a closed perimeter around a top edge of the top surface for coming in direct contact with a work piece to form a first seal with the work piece; and a perimeter recessed channel molded into the top rubber body and defining a first closed path on the top surface of the top rubber body enclosing the vacuum area and sealing cord residing in the perimeter recessed channel for coming in direct contact with the work piece to form a second seal with the work piece inside the first seal;

work piece supports molded into the top surface of the top rubber body and residing inside the first closed path defined by the perimeter recessed channel, the work piece supports slightly below the sealing lip when the work piece is not resting on the sealing lip;

at least one interior recessed channel connecting spaced apart points on the perimeter recessed channel and passing between at least two of the work piece supports, the sealing cord forming a second closed path including the at least one interior recessed channel and part of the perimeter recessed channel and defining a smaller area inside a larger area defined by the first close path, the sealing cord coming in direct contact with the work piece to form a third seal with the work piece for holding small parts;

a center portion including vertical passages separated by vertical walls, the vertical passages placing the fixed vacuum passage in communication with the vacuum source and the first bottom surface of the top rubber body includes a groove pattern matching the vertical walls of the center portion;

the vertical walls include ports at a base of the center portion and the vertical passages in communication with the vacuum source through the ports to provide vacuum to all of the vertical passages when the vacuum is applied to one of the vertical passages;

a bottom rubber body including:

a second top surface including the same groove pattern as the first bottom surface of the top rubber body for attaching to the center portion; and a second bottom surface including the sealing lip and the recessed channels and additionally including partitioning walls blocking the communication of vacuum between a right side, and center, and a left side of a second vacuum area on the second bottom surface of the bottom rubber body for controllably allowing a first vacuum source to hold the vacuum cup to the machine and a second vacuum source to hold the work piece to the vacuum cup; and plugs insertable into the vertical passages to block the vacuum from communicating to the top rubber body though the blocked vertical passage for allowing use of a partial rubber body.

* * * * *